United States Patent [19]

Bloom

[11] Patent Number: 4,514,658

[45] Date of Patent: Apr. 30, 1985

[54] MESH LENS FOCUS MASK FOR A CATHODE-RAY TUBE

[75] Inventor: Stanley Bloom, Bridgewater, N.J.

[73] Assignee: RCA Corporation, Princeton, N.J.

[21] Appl. No.: 480,762

[22] Filed: Mar. 31, 1983

[51] Int. Cl.[3] ..... H01J 29/07

[52] U.S. Cl. ..... 313/402; 313/403; 313/408

[58] Field of Search ..... 313/403, 408, 402

[56] References Cited

U.S. PATENT DOCUMENTS

| | | | |
|---|---|---|---|
| Re. 26,035 | 6/1966 | Lawrence | 315/21 |
| 2,728,024 | 12/1955 | Ramberg | 315/17 |
| 2,793,317 | 5/1957 | Lawrence | 315/21 |
| 2,951,179 | 8/1960 | Evans | 315/15 |
| 3,030,536 | 4/1962 | Hackett et al. | 313/80 |
| 3,102,212 | 8/1963 | Schlesinger | 315/12 |
| 3,421,048 | 1/1969 | Christensen | 315/31 |
| 3,502,942 | 3/1970 | Khan et al. | 313/408 X |
| 3,586,900 | 6/1971 | Seki et al. | 315/15 |
| 3,688,359 | 9/1972 | Oikawa et al. | 29/25.14 |
| 4,059,781 | 11/1977 | van Alphen et al. | 313/403 |
| 4,121,131 | 10/1978 | van Esdonk et al. | 313/402 |
| 4,207,490 | 6/1980 | Van der Ven | 313/403 |
| 4,316,126 | 2/1982 | Hockings et al. | 315/375 |

OTHER PUBLICATIONS

P. Grivet, Electron Optics, pp. 224–227, (2nd English Edition).

*Primary Examiner*—Palmer Demeo

*Attorney, Agent, or Firm*—Eugene M. Whitacre; Dennis H. Irlbeck; Vincent J. Coughlin, Jr.

[57] ABSTRACT

The novel CRT is similar in structure to prior art CRT's except for the color-selection structure, which, as in the prior CRT's is for producing a plurality of lenses for passing and focusing portions of electron beams to associated color groups of the target. In the novel CRT, the color-selection structure comprises at least one lenticular member having therein an array of windows associated with only one color group, each window having a half-width, r, and a conductive mesh having interstitial dimensions small compared to the phosphor elements in the color groups. The lenticular member is longitudinally spaced a distance, s, from the conductive mesh so that the ratio of the longitudinal spacing, s, to the half-width, r, of the window is much less than unity ($s/r << 1$), so that the lenticular member and the conductive mesh provide a strong lens action.

17 Claims, 20 Drawing Figures

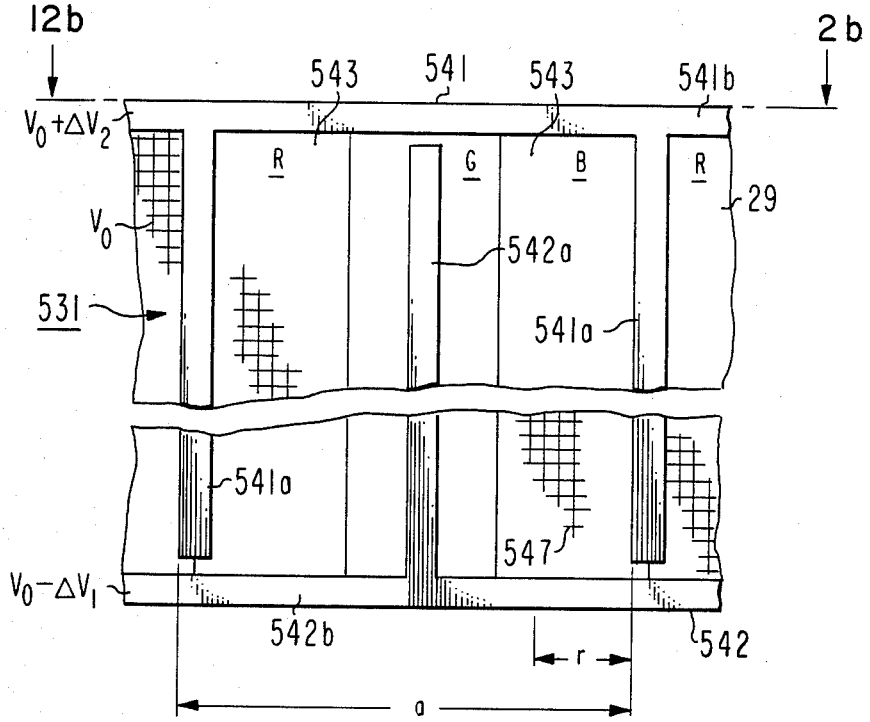
12a
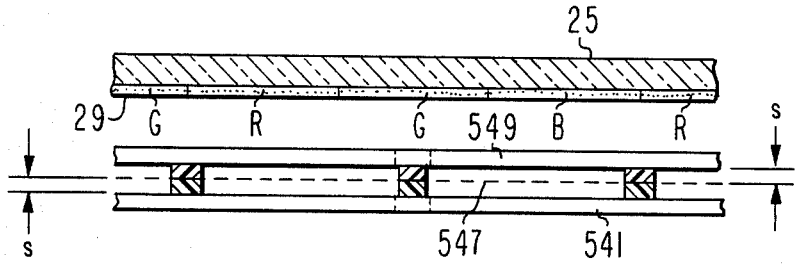
12b

MESH LENS FOCUS MASK FOR A CATHODE-RAY TUBE

BACKGROUND OF THE INVENTION

The present invention relates to a novel CRT (cathode-ray tube) having an improved focusing color-selection structure.

A commercial shadow-mask-type color television picture tube, which is a type of CRT, comprises generally an evacuated envelope having therein a target comprising an array of phosphor elements of three different emission colors arranged in cyclic order, means for producing three convergent electron beams directed towards the target, and a color-selection structure including an apertured masking plate between the target and the beam-producing means. The masking plate shadows the target and, therefore, is also called a shadow mask. The differences in convergence angles permit the transmitted portions of each beam, or beamlets, to select and excite phosphor elements of the desired emission color. At about the center of the color-selection structure, the masking plate of this commercial CRT intercepts all but about 18% of the beam currents; that is, the plate is said to have a transmission of about 18%. Thus, the area of the apertures of the plate is about 18% of the area of the mask. Since there are no focusing fields present, a corresponding portion of the target is excited by the beamlets of each electron beam.

Several methods have been suggested for increasing the transmission of the masking plate; that is, increasing the area of the apertures relative to the area of the plate, without substantially increasing the excited portions of the target area. In one approach, each of the apertures of the color-selection structure is defined by a quadrupolar electrostatic lens which focuses the beamlets passing through the lens in one direction and defocuses them in another direction on the target depending upon the relative magnitudes and polarities of the electrostatic fields comprising the lens. A quadrupolar lens structure utilizing the above-described approach is described in U.S. Pat. No. 4,059,781 issued to W. M. van Alphen et al., on Nov. 22, 1977. In the van Alphen et al. patent, the quadrupolar lens focus mask is formed by applying voltages between two sets of substantially-parallel conducting strips, each set being orthogonally positioned with respect to the other, and insulatingly bonded at the intersection of the strips.

In another approach, the apertures are arranged in columns opposite substantially parallel phosphor stripes in the target. Each aperture in the masking plate is enlarged and split into two adjacent windows by a conductor. The two beamlets passing through adjacent windows are deflected towards one another, and both beamlets fall on substantially the same area of the target. In this approach, the transmitted portions of the beams are also focused in one transverse direction and defocused in the orthogonal transverse direction. Such a combined deflection-and-focus lens structure is described in West German Offenlegungschrift No. 2,814,391 published Oct. 19, 1978. The deflection-and-focus, or dipole-quadrupolar lens structure comprises a metal-masking plate having therein an array of substantially rectangular apertures arranged in vertical columns and a single array of narrow vertical conductors in the form of wires insulatingly spaced and supported from one major surface of the masking plate, with each wire conductor substantially centered over the apertures of one of the columns of apertures. Each wire conductor is unsupported and uninsulated over each aperture. Viewed from the electron-beam-producing means, the conductors divide each aperture into two essentially-equal horizontally-coadjacent windows.

When operating this latter device, the narrow vertical conductors are electrically biased with respect to the masking plate, so that the beamlets passing through each of the windows of the same aperture are deflected horizontally away from the positively-biased side of the window. Simultaneously, because of quadrupole-like focusing fields established in the windows, the beamlets are focused (compressed) in one direction of the phosphor stripes and defocused (stretched) in the other direction of the phosphor stripes. The spacings and voltages are so chosen to form an array of electrostatic lenses that also deflects adjacent pairs of beamlets to fall on the same phosphor stripe of the target. The convergence angle of the beam that produces the beamlet determines which stripe of the triad is selected.

One shortcoming common to both the quadrupolar-lens and the dipole-quadrupolar lens structure is that the lenses are relatively weak and that a relatively high bias voltage is required to focus the electron beams passing through the apertures in the color-selection structure onto the target. A high bias voltage frequently leads to electrical breakdown.

SUMMARY OF THE INVENTION

The novel CRT is similar in structure to the prior CRT's mentioned above except for the color-selection structure, which, as in the prior CRT's is for producing a plurality of lenses for passing and focusing portions of electron beams to associated color groups of the target. In the novel CRT, the color-selection structure comprises at least one lenticular member having therein an array of windows associated with only one color group, each window having a half-width, r, and a conductive mesh having interstitial dimensions small compared to the phosphor elements in the color groups. The lenticular member is longitudinally spaced a distance, s, from the conductive mesh so that the ratio of the longitudinal spacing, s, to the half-width, r, of the window is much less than unity ($s/r << 1$), so that the lenticular member and the conductive mesh provide a strong lens action.

BRIEF DESCRIPTION OF THE DRAWINGS

FIG. 12*a* is a front view and FIG. 12*b* is a top-sectional view of a fragment of a sixth color-selection structure for an alternative embodiment of a novel CRT.

DETAILED DESCRIPTION OF THE PREFERRED EMBODIMENT

Figure 1:
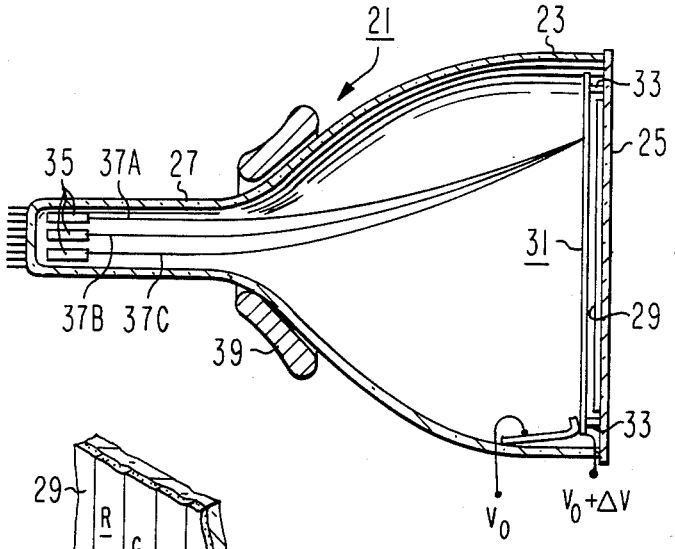
FIG. 1 is a partial sectional view of an embodiment of a novel CRT.

The color television picture tube 21 shown in FIG. 1 comprises an evacuated bulb 23 including a transparent faceplate 25 at one end and a neck 27 at the other end. The faceplate 25, which is shown as being flat, but may arc outwardly, supports a luminescent viewing screen or target 29 on its inner surface. Also, a color-selection structure 31 is supported from three supports 33 on the inside surface of the faceplate 25. Means 35 for generating three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beams 37B at the screen 29. The three beams may be deflected with the aid of deflection coils 39 to scan a raster over the color-selection structure 31 and the viewing screen 29.

Figure 2:
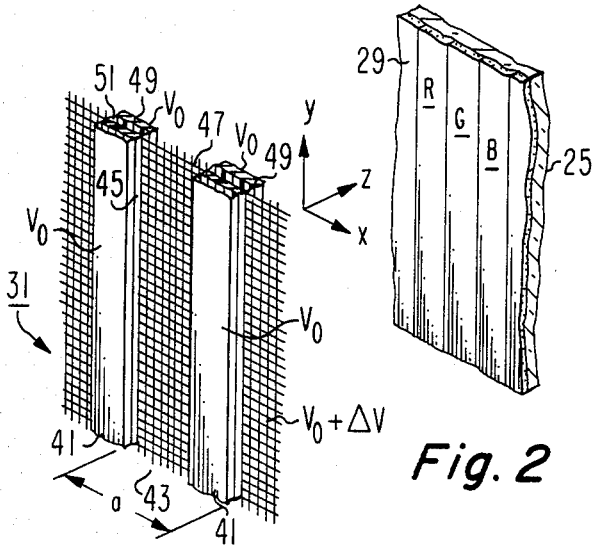
FIG. 2 is a perspective view and FIG. 3 is a top-sectional view of a portion of the color-selection structure of the novel CRT shown in FIG. 1.
Figure 3:
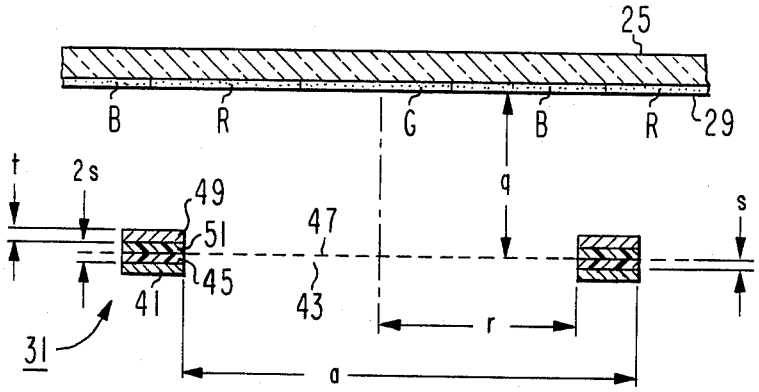

The viewing screen 29 and the color-selection structure 31 are described in more detail with respect to FIGS. 2 and 3. The viewing screen 29 comprises a large number of red-emitting, green-emitting and blue-emitting phosphor stripes R, G and B, respectively, arranged in color groups of three stripes or triads in a cyclic order and extending in a direction which is generally normal to the plane in which the electron beams are generated. In the normal viewing position for this embodiment, the phosphor stripes extend in the vertical or y direction. The phosphor stripes also could be separated from each other in the horizontal or x direction by light-absorbing material as is known in the art. In a 25 inch television picture tube, the width of each phosphor stripe is about 0.25 mm (10 mils).

The color-selection structure 31 comprises a plurality of spaced-apart parallel conductive strips 41 which extend in the vertical direction parallel to the major axis of the phosphor stripes R, G and B. The strips 41 are disposed between the beam generating means 35 and the screen 29. The strips 41 are periodically spaced in the horizontal direction and form an array of substantially rectangular windows or apertures 43 which are associated with only one color group or triad of phosphor stripes on the screen 29. Each of the windows 43 has a half-width, r, measured from the center of the window to the edge thereof. The green stripe is at the center of each triad, and is centered opposite the windows 43. Closely spaced in the longitudinal or z direction from the conductive strips 41 by a plurality of first insulators 45 formed from Pyralin, for example, that are of the order of 0.025 to 0.075 mm (1–3 mils) thick is a conductive mesh electrode 47. The mesh electrode 47 may comprise a woven member, an etched or electroformed foil or film, or a membrane pervious to electrons. Preferably, the mesh electrode 47 has a multiplicity of openings to permit the electrons from the beams to pass therethrough. Mesh elements having 400 openings per inch or about 16 openings per mm are commonly available; however, such a fine mesh element is not necessary unless the half-width, r, of the window 43 is very small. More commonly, a coarser mesh element which produces a reasonably smooth unipotential across the window 43 and has interstitial dimensions which are small compared to the width of the phosphor stripes may be used. Disposed between the mesh electrode 47 and the screen 29 are a plurality of spaced-apart parallel conductive strips 49 which are aligned with the strips 41. A plurality of second insulators 51 also formed from Pyralin, that are of the order of 0.025 to 0.075 mm (1–3 mils) thick space the strips 49 from the mesh electrode 47. The strips 41 and 49 in combination with the conductive mesh electrode 47 form a bilateral slit-type Mesh Lens focus mask 31 comprising a plurality of Mesh Lenses for passing and focusing the electron beams 37A, 37B and 37C to associated color groups of phosphor stripes or triads of the screen 29. Bilateral, in this context, means that the conductive strips 41 and 49 are disposed on both sides of the mesh electrode 47. While a bilateral structure is preferred for reasons to be discussed hereinafter, the Mesh Lens focus mask 31 may be a unilateral structure having conductive strips disposed on only one side of the mesh electrode 47.

In this embodiment, a first positive voltage, $V_o$, of about 25,000 volts is applied to the screen 29 and to the conductive strips 41 and 49 of the Mesh Lens focus mask 31. A second positive voltage, $V_o+\Delta V$, of about 25,000 volts plus about 250 to 350 volts is applied to the mesh electrode 47. The electron-beam-producing means 35 is energized by suitable voltages to produce the three convergent beams 37A, 37B and 37C which are made to scan a raster on the viewing screen 29 with the aid of the deflection coils 39. The beams approach the slit-type Mesh Lens focus mask 31 at different but definite angles. Each beam is much wider than the apertures 43 and, therefore, spans many apertures. Each beam produces many beamlets, which are portions of the beam which pass through the apertures.

Figure 4A:
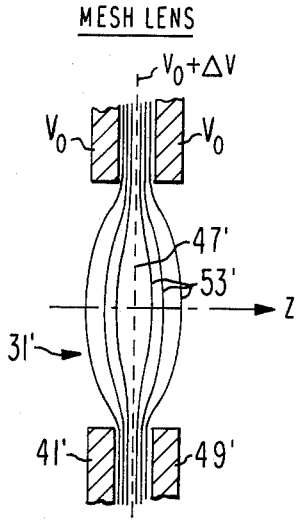
FIG. 4*a* is a top-sectional view of a Mesh Lens showing the equipotential lines associated with a strongly convergent lens having the potentials indicated.
Figure 5A:
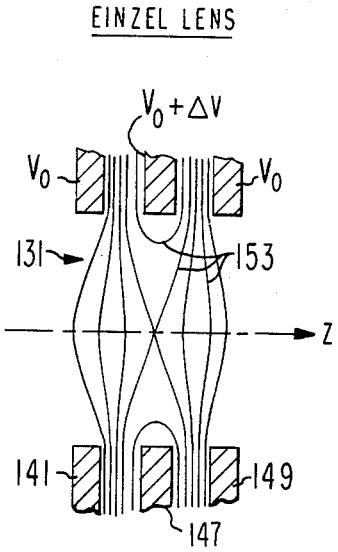
Fig. 5a PRIOR ART
FIG. 5*a* is a top-sectional view of a conventional einzel lens having the same potentials applied thereto as indicated in FIG. 4*a* and the equipotential lines resulting therefrom.
Figure 4B:
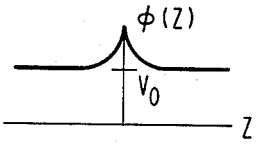
FIG. 4*b* is a plot of the potential distribution and FIG. 4*c* is a plot of the second derivative of the potential distribution for the Mesh Lens of the FIG. 4*a* convergent lens having the relative potentials indicated.
Figure 5B:
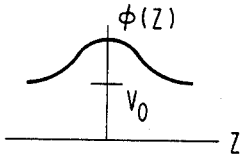
FIG. 5*b* is a plot of the potential distribution and FIG. 5*c* is a plot of the second derivative of the potential distribution for the einzel lens of FIG. 5*a*.
Figure 4C:
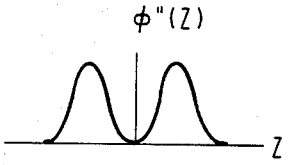
Figure 5C:
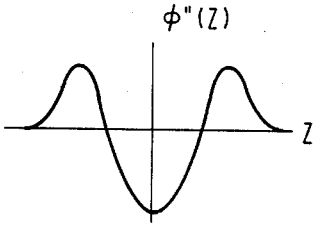

Electrostatic fields are produced in each aperture 43 by the voltages applied to the strips 41 and 49 and to the mesh electrode 47. The operation of the Mesh Lens focus mask 31 can be understood by a general discussion of the Mesh Lens 31' shown in FIG. 4*a*. In FIG. 4*a*, a bilateral Mesh Lens 31' comprising a plurality of aligned conductive strips 41' and 49' are disposed in spaced relation on opposite sides of a conductive mesh electrode 47'. Potentials are applied to the strips 41', 49' and to the mesh electrode 47'. The potentials applied to strips 41' and 49' are equal to one another and are indicated as a positive potential, $V_o$. A potential slightly positive by an amount $\Delta V$ is applied to the mesh electrode 47'. The potential distribution, $\phi(z)$, along the z-axis, is shown in FIG. 4*b*. In the resultant bilateral Mesh Lens 31', the mesh electrode 47' extends the equipotential lines 53' smoothly across the z-axis of the lens. As shown in FIG. 4c, the second derivative, $\phi''(z)$, of the potential distribution, $\phi(z)$, is everywhere positive when $\Delta V$ is positive so that the focusing force, determined by the transverse electric field which is proportional to the second derivative of the potential, provides a Mesh Lens 31' which is convergent for all values of z. Contrast the operation of the Mesh Lens 31' with the operation of a conventional einzel lens 131 shown in FIG. 5a. The equipotential lines 153 produced by an einzel lens 131 comprising conductive strips 141 and 149 disposed on opposite sides of center conducting strips 147 do not all extend smoothly across the z-axis of the einzel lens 131. A plot of the potential distribution, $\phi(z)$, and the second derivative, $\phi''(z)$, of the potential for an einzel lens are shown in FIGS. 5b and 5c, respectively. Since the focusing force is proportional to the second derivative, $\phi''(z)$, of the potential, $\phi(z)$, the focusing force of the einzel lens 131 converges ($\phi''(z)$ positive) the electrons in the beam where they travel slowly and diverges ($\phi''z$) negative) the electrons where they travel fast to produce a small net convergence of the electron beam. Thus, the bilateral Mesh Lens 31' is a stronger, i.e., more convergent, lens than an einzel lens 131.

Figure 9:
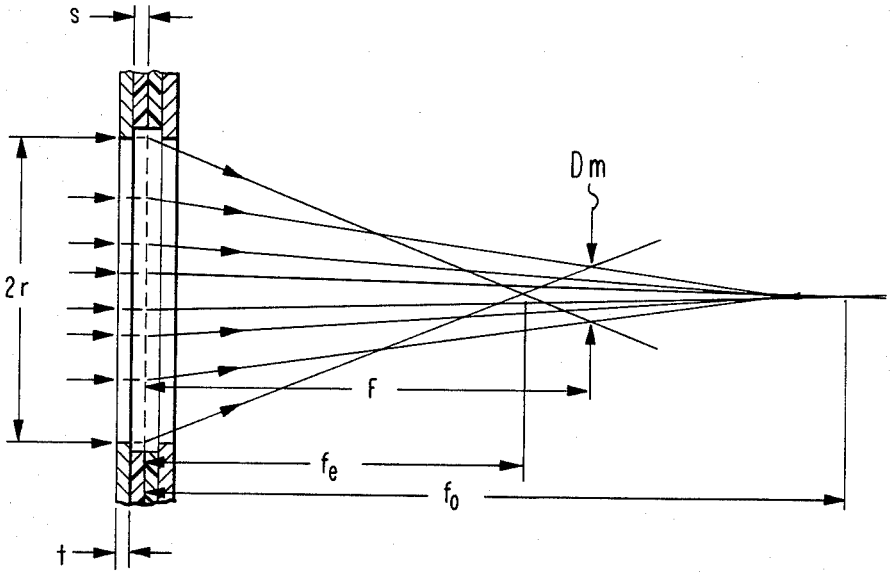
FIG. 9 is a diagram showing the edge-ray focal length, $f_e$, the paraxial-ray focal length, $f_o$, and the position, F, of minimum spot width, $D_m$, for a Mesh Lens focus mask such as that shown in FIG. 6.

Computer computations of the bilateral slit-type Mesh Lens focus mask 31 are listed in the TABLE for four different mask configurations. The parameters a, r, s, t and q, defined hereinafter, are indicated in FIG. 3. The period, a, for each mask listed in the TABLE is 0.762 mm (30 mils), the electrode thickness, t is 0.075 mm (3 mils), and the mask-to-screen distance, "q", is 13.72 mm (540 mils). The dimensions and distances listed in the TABLE are given in mils and the voltages are in kilovolts. In these calculations, $V_o$, the potential on the strips 41 and 49, was assumed to be 10 kV, and the mesh potential was assumed to be $V_o+\Delta V=11$ kV. The quantities $f_e$, $f_o$, $D_m$ and F listed in the TABLE are shown in FIG. 9. The last column of the TABLE gives the bias voltage, $(\Delta V)_{cp}$, required to make the spot width at the screen equal to one-third of the phosphor period. This is the color purity condition to cause the electron beamlets to impinge on one phosphor element of each phosphor color group.

TABLE

| Mask No. | Electrode thickness t (mils) | Aperture Width 2r (mils) | Electrode Separation 2s (mils) | Ratio s/r | Paraxial Focal Length $f_o$ (mils) | Edge-Ray Focal Length $f_e$ (mils) | Location of Minimum Spot Width F (mils) | Minimum Spot Width $D_m = \frac{2r}{f_e}(F - f_e)$ (mils) | Bias Voltage for Color Purity $(\Delta V)_{cp} = \frac{F}{540}\left(\frac{0.667}{1 - D_m/a}\right)$ (kilovolts) |
|---|---|---|---|---|---|---|---|---|---|
| 1 | 3 | 22 | 2 | 0.091 | 159 | 56 | 71 | 5.9 | 0.109 |
| 2 | 3 | 22 | 4 | 0.182 | 150 | 77 | 90 | 3.7 | 0.127 |
| 3 | 3 | 18 | 2 | 0.111 | 116 | 52 | 63 | 3.8 | 0.089 |
| 4 | 3 | 18 | 4 | 0.222 | 115 | 65 | 75 | 2.8 | 0.102 |

With respect to bilateral Mesh Lens mask number 1 of the TABLE, for example, the bias voltage required to achieve color purity is only 0.109 kV at an ultor voltage of 10 kV. For the more common ultor voltage of 25 kV, the bias required would be proportionately more, i.e. 0.273 kV. This voltage is considerably less than the bias voltage of 0.625 kV, at an ultor voltage of 25 kV for a conventional quadrupole focus mask having the same periodicity, a, and the same aperture size, 2r, as Mesh Lens mask number 1. It can be seen from the TABLE that decreasing the aperture width from 22 to 18 mils (mask 1 versus mask 3) strengthens the lens, i.e., the bias voltage for color purity decreases from 0.109 kV for mask 1 to 0.089 kV for mask 3, and decreasing the longitudinal electrode separation from 4 mils to 2 mils (mask 2 versus mask 1, and mask 4 versus mask 3) also strengthens the lens.

Figure 6:
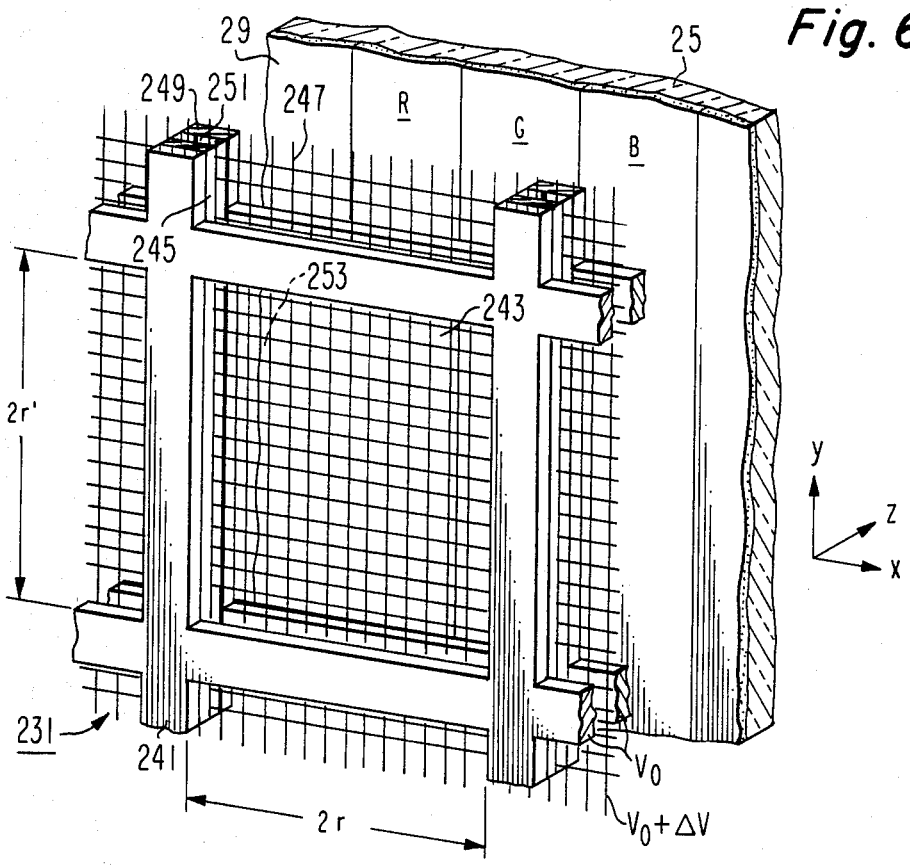
FIG. 6 is a perspective view and FIG. 7 is a top-sectional view of a fragment of a second color-selection structure for an alternative embodiment of a novel CRT.
Figure 7:
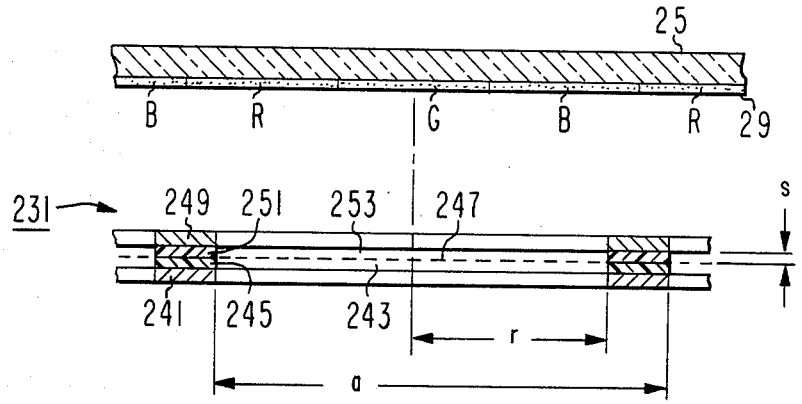

The above-described slit-type Mesh Lens focus mask 31 provides focusing in only the horizontal direction since the strips 41 and 49 extend vertically. The Mesh Lens focus mask 231 shown in FIGS. 6 and 7 provides focusing in both the horizontal and vertical directions. A first masking plate 241 is disposed between the beam generating means 35 and the screen 29. The masking plate 241 has a large number of openings or apertures 243 therein. The apertures 243 are preferably rectangular and are arranged in columns, which are parallel to the long or vertical direction of the phosphor stripes R, G and B, there being one column of apertures associated with each triad of stripes. Closely spaced in the longitudinal direction from the masking plate 241 by a first insulator member 245 formed from Pyralin, for example, that is of the order of 0.025 to 0.075 mm (1–3 mils) thick is a conductive mesh electrode 247. The mesh electrode 247 is identical to the mesh electrode 47 described previously. Disposed between the mesh electrode 247 and the screen 29, is a second masking plate 249. The second masking plate 249 also has a large number of openings or apertures 253 therein which are aligned with the apertures 243 in the first masking plate 241. A second insulator member 251 also formed from Pyralin that is of the order of 0.025 to 0.075 mm (1–3 mils) thick spaces the second masking plate 249 from the mesh electrode 247. The masking plates 241 and 249 in combination with the conductive mesh electrode 247 form a bilateral Mesh Lens focus mask 231 comprising a plurality of Mesh Lenses for passing and focusing the electron beams 37A, 37B and 37C to associated color groups of phosphor stripes or triads on the screen 29. In this embodiment a first positive voltage, $V_o$, of about 25,000 volts is applied to the screen 29 and to the masking plates 241 and 249. A second positive voltage, $V_o+\Delta V$ of about 25,000 volts plus about 250 to 350 volts is applied to the mesh electrode 247. The electron beam producing means 35 is energized by suitable voltages to produce the three convergent beams 37A, 37B and 37C. Electrostatic fields are produced in the apertures 243 and 253 by the voltages applied to the masking plates 241 and 249 and to the mesh electrode 247.

As shown in FIG. 6, the apertures 243 and 253 are preferably rectangular having a horizontal dimension, 2r, and a vertical dimension, 2r' where $r<r'$. Since the horizontal dimension, 2r, is less than the vertical dimension, 2r', the beamlets in the horizontal plane will have shorter focal lengths, i.e., be more strongly focused, than the beamlets in the vertical plane. This behavior is required for a line-type screen in which the phosphor stripes extend in the vertical direction.

Figure 8A:
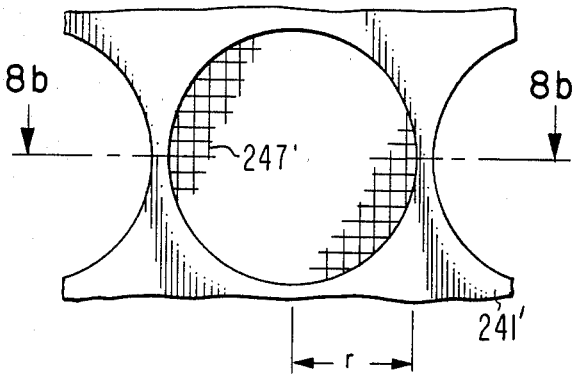
FIG. 8*a* is a front view and FIG. 8*b* is a top-sectional view of a fragment of a third color-selection structure having circular apertures but otherwise similar to the structures shown in FIGS. 6 and 7.
Figure 8B:
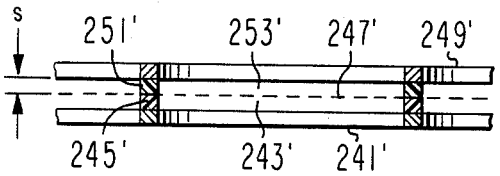

While the bilateral Mesh Lens focus masks 31 and 231 describe structures having slit-type and substantially rectangularly-shaped apertures, respectively, the bilateral Mesh Lens focus mask may also have substantially circular apertures when a dot screen is utilized. Such a Mesh Lens focus mask 231' is shown in FIGS. 8*a* and 8*b* where the use of the prime designates similar element to those shown in FIGS. 6 and 7.

Circular apertures provide a cylindrically-symmetric potential along the axis of the lens. The paraxial focal length, $f_o$, for a cylindrically-symmetric bilateral lens having an aperture of radius (half-width), r, and longitudinal separation, s, between the apertured masking plate and the mesh electrode is given approximately by the following general formula:

$$f_o=(2sV_o/\Delta V)/\tanh(1.32\ s/r). \quad (3)$$

The corresponding general formula for a unilateral cylindrically-symmetric lens is given by the formula:

$$f_o=2(2sV_o/\Delta V)/\tanh(1.32\ s/r). \quad (3a)$$

Formula (3*a*) reflects the fact that a unilateral lens is only one-half as strong as a bilateral lens so that the paraxial focal length is twice as great. For the specific Mesh Lens, the ratio, s/r, of the longitudinal spacing, s, to the radius, r, of the window is much less than unity ($s/r<<1$). Thus, for $s/r<<1$, tanh (1.32 s/r) reduces to the expression 1.32 s/r and the paraxial focal length formula (3) reduces to the following:

$$f_o=2rV_o/1.32\Delta V \quad (4)$$

Thus, for the Mesh Lens the paraxial focal length, $f_o$, is essentially independent of the spacing s when $s/r<<1$. This is also true in the case of a slit-type Mesh Lens, such as lens 31, as can be seen from the TABLE.

Not all lens structures employing an intermediate electron-pervious electrode, such as mesh electrodes 47 and 247, behave as specific Mesh Lenses or obey formula (4). For example, in U.S. Pat. No. 3,586,900 issued to Seki et al., on June 22, 1971, a unilateral structure is shown in FIG. 8 of the Seki et al. patent in which an apertured masking plate, having apertures with a radius, r, of 0.25 mm, is longitudinally spaced a distance, s, equal to 0.25 mm from a mesh electrode. The "q"-spacing between the mesh electrode and screen is given to be 20 mm. In the Seki et al. structure, the ratio is $s/r=1$ and formula (3*a*) becomes, since tanh (1.32 s/r) is now approximately unity, $$f_o\cong 4sV_o/\Delta V \quad (4a)$$

Solving equation (4*a*) for the bias voltage, $\Delta V$, required to focus the electron beams on the screen, provides the following equation $$\Delta V\cong 4sV_o/f_o \quad (5)$$

Equation (5) yields a bias voltage of 1 kV for an ultor potential of 20 kV, a "q" spacing of $q=f_o=20$ mm, and a longitudinal spacing, s, of 0.25 mm. This calculated value is in good agreement with the focus bias voltage of 1.1 kV disclosed in the Seki et al. patent.

Contrast the high focus bias voltage required for the Seki et al. structure with that required for the present novel bilateral Mesh Lens structures such as lens structures 31, 231 and 231' in which the longitudinal spacing, s, is reduced to only 2 mils (0.050 mm) with the other parameters the same as in the Seki et al. structure. Since s/r, (0.050/0.25), is much less than unity in the present bilateral Mesh Lens structures, the focus bias voltage can be calculated from formula (4).

$$\Delta V = 2rV_o/1.32f_o \quad (6)$$

$$\Delta V = \frac{2(.25\ \text{mm})\ (20\ \text{kV})}{1.32\ (20\ \text{mm})}$$

$$\Delta V = 0.378\ \text{kV}$$

The resultant bias voltage of 378 volts for the present Mesh Lens structures having an s/r ratio of much less than unity is considerably less than the 1 kV focus bias voltage required by the Seki et al. structure having an s/r ratio of unity or greater.

The present novel Mesh Lens structures in which the longitudinal spacing between electrodes is much less than the half-width of the apertures, i.e., $s/r<<1$, provides a much stronger lens than was available heretofore in a cathode-ray tube color-selection structure.

In addition, the present novel Mesh Lens focus masks having a ratio of $s/r<<1$ eliminate the tunnel-like apertures present in the prior art color-selection structures. Such prior art structures drastically reduced the transmission for oblique beamlets near the edges of the color-selection structures. Furthermore, the relatively thin present novel Mesh Lens focus masks are easier to form into non-planar configurations than the prior art structures represented by the Seki et al. structure.

While the novel Mesh Lens focus masks have been described as comprising lenticular members of rectangular cross-section such as strips 41, 49 and masking plates 241, 249 it should be clear that the invention is not so limited, and lenticular members of other cross-section, such as circular, oval, or trapezoidal, may be utilized.

Figure 10A:
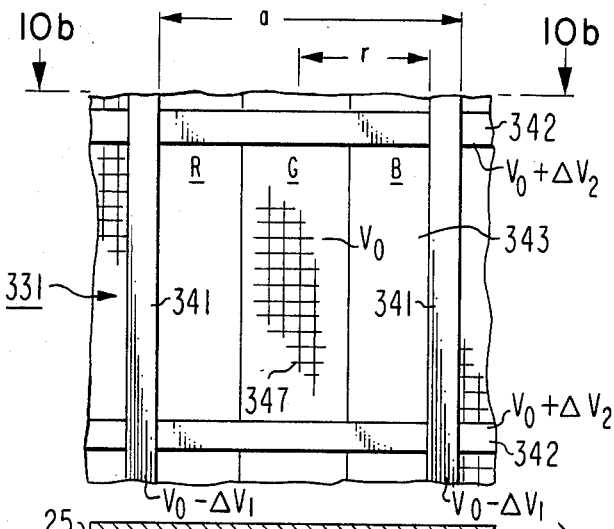
FIG. 10*a* is a front view and FIG. 10*b* is a top-sectional view of a fragment of a fourth color-selection structure for an alternative embodiment of a novel CRT.
Figure 10B:
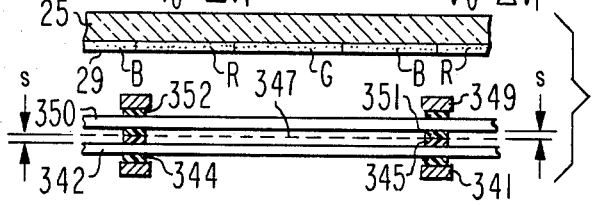

The strong focusing of the Mesh Lens can be combined with other types of color-selection structures to create hybrid Mesh Lens structures such as those shown in FIGS. 10 through 12. In FIGS. 10*a* and 10*b*, a bilateral quadrupole Mesh Lens focus mask 331 is shown. The structure 331 comprises a plurality of vertically disposed conductive strips 341 and a plurality of horizontally disposed conductive strips 342. An insulative material 344 such as Pyralin, provides electrical insulation between the conductive strips 341 and 342 of the quadrupole structure. A conductive mesh electrode 347 is closely spaced a longitudinal distance, s, from the conductive strips 342 by an insulative material 345 such as Pyralin. The vertically and horizontally disposed strips 341 and 342 define a first quadrupole lens having a plurality of apertures 343 which are associated with only one color group or triad of phosphor stripes on the screen 29. Each of the apertures 343 has a half-width, r, which is measured transversely from the center of the aperture to the edge thereof. As shown in FIG. 10*b*, a plurality of second horizontally disposed conductive strips 350 (only one is shown) are closely spaced a longitudinal distance, s, from the conductive mesh electrode 347 by an insulator 351. The strips 350 are aligned with the strips 342 of the first quadrupole. A plurality of vertically disposed conductive strips 349 are aligned with the conductive strips 341 and spaced from the strips 350 by an insulative material 352. The conductive strips 349 and 350 form a second quadrupole lens, which in conjunction with the first quadrupole lens and the mesh electrode 347 constitute the bilateral quadrupole Mesh Lens focus mask 331.

In order to operate the bilateral quadrupole Mesh Lens focus mask 331, three voltages are required. In one mode of operation a first potential, $V_o$, equal to ultor potential is applied to the mesh electrode 347. A second potential that is slightly less positive than the ultor potential by an amount, $-\Delta V_1$, is applied to the vertically disposed strips 341 and 349. A third potential that is slightly positive with respect to the ultor potential by an amount, $\Delta V_2$, is applied to the horizontally disposed strips 342 and 350. The Mesh Lens 331 focuses the electron beams in the horizontal plane and defocuses the beams in the vertical plane but at lower voltages than was heretofore possible with a conventional quadrupole focus mask. Alternatively, other modes of operation are possible; provided the vertical strips 341 and 349 are at the lowest potential, the horizontal strips 342 and 350 are at the highest potential and the mesh electrode 347 is at an intermediate potential, any one of these three potentials can be put equal to the ultor potential, $V_o$.

Figure 11A:
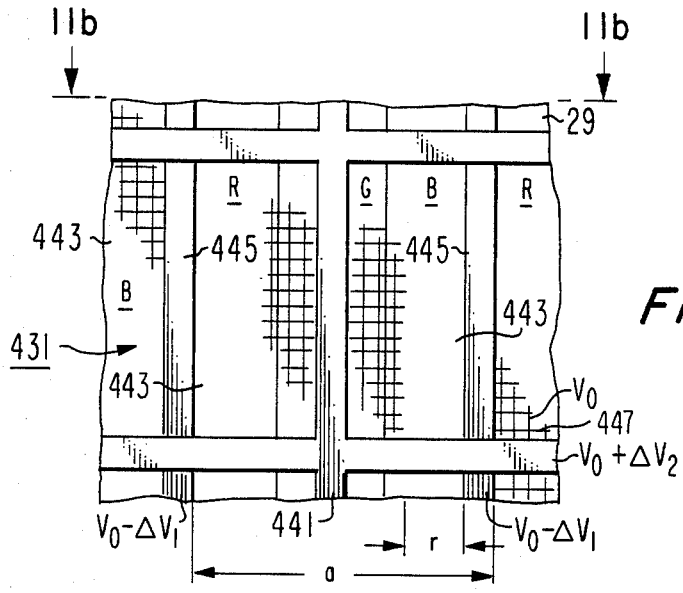
FIG. 11*a* is a front view and FIG. 11*b* is a top-sectional view of a fragment of a fifth color-selection structure for an alternative embodiment of a novel CRT.
Figure 11B:
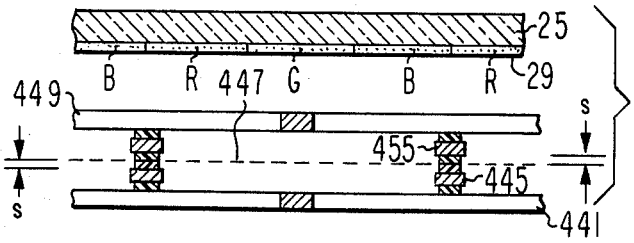

One form of a bilateral dipole-quadrupole Mesh Lens focus mask 431 is shown in FIGS. 11*a* and 11*b*. The structure 431 comprises a first masking plate 441 having a large number of rectangular openings or apertures 443 therein. Each aperture 443 has a half-width, r, measured from the center to the edge thereof. The apertures 443 are arranged in columns, which are parallel to the long direction of the phosphor stripes R, G and B. The green stripe is at the center of each triad and is in line with the spaces between columns of apertures. In other words, the vertically extending webs of the masking plate 441 are centered over the green stripes. A conductor 445 extends down each column of apertures 443 on the screen side of the masking plate 441 and opposite each triad boundary; that is, opposite the boundary between the red and blue stripes R and B. Alternatively, the conductors 445 may extend down each column of apertures on the beam producing side of the plate 441. The conductors 445 are parallel to the stripes R, G and B. The conductors 445 are so positioned over each aperture 443 so as to leave two substantially equal electron-transmitting parts, as viewed from the electron-beam-producing means 35. A conductive mesh electrode 447 is closely spaced a longitudinal distance, s, from the conductors 445. Suitable insulators, for example of Pyralin, are disposed between the aforementioned conductive member to provide electrical insulation. The insulative material has a thickness of about 0.025 to 0.075 mm (1 to 3 mils). A second masking plate 449 and a plurality of second conductors 455 are disposed on the opposite side of the mesh electrode 447 and aligned with the first masking plate 441 and the conductors 445, respectively to provide a bilateral structure.

Three voltages are required to operate the bilateral dipole-quadrupole Mesh Lens focus mask 431. In one mode of operation a first potential, $V_o$, equal to ultor potential is applied to the mesh electrode 447. A second potential that is slightly less positive than the ultor potential by an amount, $-\Delta V_1$, is appplied to the conductors 445 and 455. A third potential that is slightly positive with respect to the ultor potential by an amount, $\Delta V_2$, is applied to the masking plates 441 and 449. Again, provided these relative values are maintained any one of these three potentials can be put equal to the ultor potential. The bilateral dipole-quadrupole Mesh Lens focus mask 431 provides vertical defocusing and both horizontal focusing and horizontal deflection at a lower bias voltage than is possible using a conventional dipole-quadrupole color-selection structure such as that described in U.S. Pat. No. 4,316,126 issued to Hockings et al., on Feb. 16, 1982.

FIGS. 12*a* and 12*b* show a bilateral dipole Mesh Lens focus mask 531 comprising first and second conductive members 541 and 542. The conductive members 541 and 542 lie in a common plane and are closely spaced a longitudinal distance, s, from and parallel to a mesh electrode 547, by a suitable insulator, for example of Pyralin, having a thickness of about 0.025 to 0.075 mm (1–3 mils). The conductive members 541 and 542 comprise interleaved, spaced apart conductive strip portions 541*a* and 542*a* connected at one end by bus portions 541*b* and 542*b*, respectively. The area between the interleaved strip portions form the windows or apertures 543. In the bilateral dipole Mesh Lens structure 531, the half-width, r, of the window is measured transversely from one of the strip portions 541*a* half way to the next adjacent strip portion 542*a*. The conductive strip portions 542*a* of the conductive member 542 are centered over the green stripes on screen 29 and extend parallel thereto. The conductive strip portions 541*a* are disposed opposite to the boundary between the red and blue stripes R and B. A third and a fourth conductive members 549 and 550 lie in a common plane on the opposide side of the mesh electrode 547 and are closely spaced thereto a longitudinal distance, s, by a suitable insulator having a thickness of about 0.025 to 0.075 mm (1–3 mils). The conductive members 549 and 550 comprised interleaved, spaced apart conductive strip portions 549*a* and 550*a* connected at one end by bus portions 549*b* and 550*b*, respectively. The strip portions 549*a* are aligned with the strip portions 541*a* and the strips portions 550*a* are aligned with the strip portions 542*a* to form the bilateral structure.

Three voltages are required to operate the bilateral dipole Mesh Lens focus mask 531. In one mode of operation a first potential, $V_o+\Delta V_2$, positive with respect to the ultor potential, $V_o$, is applied to the first and third conductive members 541 and 549. A second potential, $V_o-\Delta V_1$, negative with respect to the ultor potential is applied to the second and fourth conductive members 542 and 550. A third potential, $V_o$, equal to the ultor potential is applied to the mesh electrode 547. Again, other modes of operations are possible; provided these forementioned realtive values of potential are maintained, any one of the three potentials can be put equal to the ultor potential $V_o$. The bilateral dipole Mesh Lens focus mask 531 provides both horizontal focusing and horizontal deflection at a lower bias voltage than is possible using a conventional dipole color-selection structure without the mesh electrode.

General Considerations

The various embodiments of the Mesh Lens focus masks described herein provide strong focusing of the electron beams because of the close longitudinal spacing, s, between the mesh electrode and the conductive members of the focus mask, relative to the half-width, r, of the apertures in the conductive members. It is because of this condition of small ratio, i.e, $s/r << 1$, that the Mesh Lens has its unique properties. Not only is the paraxial focal length, $f_o$, small, but the edge-ray focal length, $f_e$, is even smaller, (as shown in the TABLE and in FIG. 9). This small $f_e$ causes the location, F, of minimum spot width to be much shorter than the paraxial focal length, $f_o$, and thus makes the lens unusually strong. In contrast, in the prior art lens structures in which the ratio of s/r is of the order of unity or greater, the edge ray focal length becomes nearly equal to the paraxial focal length and both focal lengths become relatively large. The prior art lens structure is a different type of lens than the novel Mesh Lens and is sometimes referred to as a Davisson-Calbick Lens (Phys. Rev. Vol. 38, p. 585 (1931)) which is a very weak lens and requires a large bias focus voltage.

To ensure that the potential distribution due to the mesh electrode is relatively uniform or smooth across the longitudinal axis, a sufficiently large number of mesh apertures are required and the mesh transmission should be as high as possible to maximize the advantage of the focus mask. In other words, the interstitial dimensions of the mesh electrode are small compared to the width of the phosphor stripes.

Consider for example a mesh electrode etched from 0.0125 mm (0.5 mil) foil with about 16 "square" apertures per mm (400 apertures per inch, or 400 gauge mesh), and having webs of 0.0125 mm (0.5 mils). Such a mesh electrode would have a transmission of 64%. If an electrode system of horizontal and vertical strips having a width of 0.2 mm (8 mils) and a period of 0.75 mm (30 mils) is also used, such as that shown, e.g., in FIG. 6, but with $2r=2r'=0.55$ mm (22 mils), the electrode system would have a transmission of 54%. A Mesh Lens focus mask formed by combining the horizontal and vertical strips with the etched mesh electrode would have an overall transmission equal to the product of the individual transmissions, or 35% which is approximately double the transmission of the conventional shadow mask. The transmission of the Mesh Lens focus mask can be increased, for example, by using an electrode system with only vertical strips of 0.2 mm (8 mil) width, as shown, for example, in FIG. 2. The transmission of the electrode system is then 73% and the vertical strips and mesh electrode combination would have a transmission of 47%.

A bilateral slit-type Mesh Lens focus mask 31, similar to the mask shown in FIG. 2 was constructed using 250 gauge mesh with an electron transmission of 68%. The mesh was insulatingly positioned between electrodes having a circular cross section of 0.21 mm (8.2 mils) and having a period, $a=0.76$ mm (30 mils). The transmission of the electrode system was $21.8/30=73\%$. The overall transmission of the Mesh Lens focus mask was therefore $0.73\times0.68$, or 49%, which is about two and a half times the transmission of a conventional non-focusing shadow mask. The separation, s, between the electrodes and the mesh electrode was 0.025 mm (1 mil), and the aperture width, 2r, was 0.55 mm (21.8 mils). The resulting ratio of s/r was 0.092, a small value as prescribed. A computer computation of this Mesh Lens focus mask 31 yielded a color-purity bias voltage $(\Delta V)_{c.p.}\cong0.080$ kV at an ultor voltage of 10 kV. The experimental value of the color-purity bias voltage $(\Delta V)_{c.p.}$ was approximately 0.090 kV. If the ultor voltage were increased to the more common value of 25 kV, the bias voltage would become 0.225 kV. This value of bias voltage is substantially less than that of any other type of focus mask, having the same transmission and period, constructed to date.

What is claimed is:

1. In a cathode-ray tube having a target comprising an array of phosphor elements of different emission colors arranged in cyclic order in adjacent color groups, each group including an element of each of said different emission colors, means for producing a plurality of electron beams directed toward said target, and a color selection structure positioned between said target and said beam producing means, said color-selection structure producing a plurality of lenses for passing and focusing portions of electron beams to associated color groups of said target, the improvement wherein said color-selection structure includes a first electrode having at least one lenticular member, a second electrode having two opposed major surfaces, one of said surfaces being insulatingly spaced from said first electrode by a longitudinal distance, s, said second electrode comprises a conductive mesh having interstitial dimensions small compared to said phosphor elements, and a third electrode having at least one lenticular member, said third electrode being spaced a longitudinal distance, s, from the other major surface of said conductive mesh, said lenticular member of said first electrode having therein an array of windows associated with only one color group, each window having a half-width, r, said lenticular member of said first electrode being disposed proximate to said conductive mesh so that the ratio of the longitudinal spacing, s, to the half-width, r, of the window is much less than unity ($s/r<<1$), whereby said electrodes provide a strong lens action.

2. The tube defined in claim 1 wherein said lenticular member of said third electrode having therein an array of windows associated with only one color group, each window having a half-width, r, measured transversely from the center of said window to the edge thereof, said member being disposed proximate to said conductive mesh so that the ratio of the longitudinal spacing, s, to the half-width, r, of the window is much less than unity ($s/r<<1$).

3. The tube defined in claim 1 including means for applying a first voltage to said lenticular member of said first electrode and means for applying a second voltage to said conductive mesh.

4. The tube defined in claim 3 including means for applying a third voltage to said lenticular member of said third electrode.

5. The tube defined in claim 1 wherein said lenticular member of said first electrode comprises a first metal masking plate.

6. The tube defined in claim 5 wherein said array of windows in said first metal masking plate are substantially rectangular.

7. The tube defined in claim 5 wherein said array of windows in said first metal masking plate are substantially circular.

8. The tube defined in claim 2 wherein said lenticular member of said third electrode comprises a second metal masking plate.

9. The tube defined in claim 8 wherein said array of windows in said second metal masking plate are substantially rectangular.

10. The tube defined in claim 8 wherein said array of windows in said second metal masking plate are substantially circular.

11. The tube defined in claim 1 wherein said first electrode includes a first and a second lenticular member, said first lenticular member being electrically isolated from said second lenticular member.

12. The tube defined in claim 11 wnerein said first and second lenticular members comprise a plurality of first and second conductive members.

13. The tube defined in claim 12 wherein said first and second conductive members are interleaved and lie in a common plane parallel to said conductive mesh, each of said second conductive members having a portion centered over one of the phosphor elements of a color group.

14. The tube defined in claim 12 wherein said first and second conductive members lie in two different parallel planes, said first conductive members being orthogonal with respect to said second conductive members.

15. The tube defined in claim 11 wherein said first lenticular member comprises a plurality of narrow conductors and said second lenticular member comprises an apertured plate having a plurality of substantially rectangular apertures formed therein, said apertures being arranged in columns, each of said narrow conductors being insulatingly spaced from said apertured plate and centered over a different one of said columns of apertures, said apertured plate and said conductors defining an array of windows for transmitting therethrough portions of said electron beams, there being two columns of windows between adjacent conductors.

16. In a cathode-ray tube having a target comprising an array of substantially parallel phosphor stripes of three different emission colors arranged in cyclic order in adjacent triads, each triad including a stripe of each of said three different colors, means for producing three convergent inline electron beams directed toward said target in a plane that is substantially normal to said stripes, and a color-selection structure positioned between said target and said beam producing means, said color-selection structure producing a plurality of lenses for passing and focusing portions of electron beams to associated triads of said target, the improvement wherein said color-selection structure comprises a mesh lens focus mask including a first electrode, a second electrode and a third electrode, said second electrode comprising a conductive mesh having two opposed major surfaces, said conductive mesh having interstitial dimensions small compared to said phosphor stripes, said conductive mesh being disposed between and spaced from said first and said third electrodes by a longitudinal distance, s, said first electrode and said third electrode having therein an array of windows associated with only one triad, each window having a half-width, r, measured transversely from the center of the window to the edge thereof, said first electrode being disposed proximate to one opposed major surface of said conductive mesh and said third electrode being disposed proximate to the other opposed major surface of said conductive mesh so that the longitudinal spacing, s, of said first and third electrodes from said conductive mesh to the half-width, r, of the windows in said first and third electrodes is much less than unity ($s/r << 1$), means for applying a first potential to said first electrode, means for applying a second potential to said second electrode, said second potential being different from said first potential so as to render the mesh lens focus mask everywhere convergent thereby providing a strong lens action, and means for applying a third potential to said third electrode.

17. The tube as defined in claim 16 wherein said third potential is equal to said first potential.

* * * * *

UNITED STATES PATENT AND TRADEMARK OFFICE

CERTIFICATE OF CORRECTION

PATENT NO. : 4,514,658

DATED : April 30, 1985

INVENTOR(S) : Stanley Bloom

It is certified that error appears in the above-identified patent and that said Letters Patent is hereby corrected as shown below:

ON THE ABSTRACT SHEET:

The following should be added under item [56] References Cited.

FOREIGN PATENT DOCUMENTS

| | | |
|---|---|---|
| 2079529A | 1/1982 | Great Britain |
| 2064212A | 6/1981 | Great Britain |

IN THE SPECIFICATION:

Column 5, Line 22 -"(ϕ" z) negative)" should read -- (ϕ"(z) negative) -- .

Signed and Sealed this

Twentieth Day of May 1986

[SEAL]

Attest:

DONALD J. QUIGG

Attesting Officer

Commissioner of Patents and Trademarks